US007343837B1

(12) United States Patent
Domanico et al.

(10) Patent No.: US 7,343,837 B1
(45) Date of Patent: Mar. 18, 2008

(54) MULTI-PLANE FLEXIBLE HANDLE FOR RATCHETS AND WRENCHES

(76) Inventors: James Anthony Domanico, 9417 E. Trent Ave., Spokane, WA (US) 99206; Joseph Allen Domanico, 206 W. School St., Greenwood, WI (US) 54437

( * ) Notice: Subject to any disclaimer, the term of this patent is extended or adjusted under 35 U.S.C. 154(b) by 0 days.

(21) Appl. No.: 11/521,415

(22) Filed: Sep. 15, 2006

(51) Int. Cl.
*B25G 1/02* (2006.01)
*B25B 23/16* (2006.01)

(52) U.S. Cl. ..... 81/177.7; 81/177.6; 81/177.9

(58) Field of Classification Search ..... 81/177.6, 81/177.7, 177.8, 177.9
See application file for complete search history.

(56) References Cited

U.S. PATENT DOCUMENTS

| | | | | |
|---|---|---|---|---|
| 1,225,822 | A * | 5/1917 | Kimball | 81/177.6 |
| 1,316,398 | A | 9/1919 | Steininger | |
| 1,431,389 | A * | 10/1922 | Frisz | 81/177.7 |
| 2,978,938 | A | 4/1961 | Nalley | |
| 3,186,265 | A * | 6/1965 | Wenturine et al. | 81/177.9 |
| 3,203,285 | A | 8/1965 | Schmidt | |
| 4,606,247 | A | 8/1986 | Graham | |
| 5,305,668 | A | 4/1994 | Davis | |
| 6,186,033 | B1 * | 2/2001 | Faro, Sr. | 81/177.7 |
| 6,216,567 | B1 | 4/2001 | Hu | |
| 6,314,844 | B1 | 11/2001 | Warner | |
| 6,336,383 | B1 | 1/2002 | Hung | |
| 6,412,374 | B1 | 7/2002 | Hsieh | |
| 6,877,404 | B2 * | 4/2005 | Chen | 81/177.7 |
| 7,066,059 | B1 * | 6/2006 | Hsieh | 81/177.7 |
| 7,171,876 | B2 * | 2/2007 | Chen | 81/177.8 |
| 2005/0051004 | A1 * | 3/2005 | Chen | 81/177.8 |

* cited by examiner

*Primary Examiner*—David B. Thomas

(57) ABSTRACT

An improved wrench for loosening and tightening objects having flexibility in two different planes of movement. The flexible drive wrench consists of an adjustable handle capable of rotating to achieve different angles along with a flexible shaft comprising of numerous steel links. The handle rotates around the flexible links when the release is engaged and locks when the release is disengaged. In addition, the steel links allow for flexibility along another plane of movement. Numerous links are connected together to form a flexible wrench by inserting a stud with a rounded end into the slotted cavity of the next link with a mushroom head steel pin connecting them. To the last link of the flexible wrench is connected a link with an open-end wrench head, closed-end wrench head, ratcheting head, or other fastening tool head for the removal of fasteners such as bolts, nuts, and other fasteners. The combination of the two planes of movement allows for a greater degree of flexibility in reaching small or confined areas with a wrench.

2 Claims, 6 Drawing Sheets

MULTI-PLANE FLEXIBLE HANDLE FOR RATCHETS AND WRENCHES

CROSS-REFERENCE TO RELATED APPLICATIONS

Not Applicable

FEDERALLY SPONSORED RESEARCH

Not Applicable

BACKGROUND OF THE INVENTION

1. Field of Invention

This invention relates to hand tools specifically to ratchets and wrenches that are used for tightening and loosening bolts and nuts.

2. Background of the Invention

Ratchet wrenches are commonly used to remove nuts and bolts without ever having to lift the wrench from the nut or bolt. Such wrenches work well for rapidly removing nuts and bolts; however, mechanics and other uses of wrenches have difficulty using them in confined or difficult-to-reach locations. In such situations, traditional rigid wrenches are difficult or impossible to use. The problem has been partially solved by a number of different inventions. Inventors created several types of pivoting handles that were designed to create a greater degree of flexibility. U.S. Pat. No. 6,336,383 to Hung (2002) discloses a relatively complex pivot that is bendable about multiple axes to have various configurations for easy use in different limited-space conditions. However, wrenches with such limited pivot points do not contain a great deal of flexibility necessary in many situations. Similarly, U.S. Pat. No. 6,216,567 to Hu (2001) also has a pivot point, however, it only pivots in one place, further limiting its range of maneuverability.

Other inventors have tried to solve the problem of difficult-to-reach bolts and nuts with limited success. U.S. Pat. No. 2,978,938 to Nalley (1961) had two separate pivot points at either end of an adjustable wrench. While this wrench provides for an added degree of flexibility to some degree, it does not allow for a great degree of flexibility in the wrench handle, and it only has one plane of movement. U.S. Pat. No. 6,314,844 to Warner (2001) had one pivoting point for use on an Allen wrench which allows for different drive angles and a greater deal of portability when stored, but it still does not provide a great deal of flexibility or movement on more than one plane.

In order to provide a greater deal of flexibility in the handle, U.S. Pat. No. 3,203,285 to Schmidt (1965) had an adjustable handle on a wrench. This tool handle was selectively adjustable to a variety of angular configurations that could then be rendered rigid. This invention required a cable to be passed through each segment of the wrench that then had to be tightened or loosened before it could be made flexible in another position. In other words, the handle position has to be pre-set by adjusting each individual segment and then tightened before it could be used. U.S. Pat. No. 4,606,247 to Graham (1986) applies a similar concept where the links meet up to form a flexible, circular chain. Each independent link contains a different sized wrench or screw-driver head. This invention speaks more of the versatility of its plurality of tools rather than the flexibility of the handle. In fact, such a configuration allows for very little flexibility.

U.S. Pat. No. 6,412,374 to Hsieh (2002) discloses a standard wrench with a multi-segmented handle composed of a predetermined number of links that are longitudinally pivotally connected with each other. The links are fitted with pivot pins that allow the body of the wrench to be bent and located in a curved state. This allows for a greater degree of flexibility, but prevents the wrench from having an adjustable piece from which to apply torque in different directions. Resilient washers are used in the pivot joints to allow the handle to retain its flexed shape while it is being used, but this decreases the overall flexibility of the wrench. In fact, the only difference between Hsieh's invention and U.S. Pat. No. 1,316,398 to Steininger (1919) is the use of resilient washers to retain shape. Both of these prior inventions are only flexible in one plane of movement, meaning that the wrench could be flexible up and down, but not also left and right.

BACKGROUND OF INVENTION

Objects and Advantages

Accordingly, several objects and advantages of my invention are:

(a) to provide a tool flexible in multiple planes with which to loosen and tighten nuts and bolts (b) to reach into spaces not possible with rigid-construction wrenches by having a segmented handle such that the handle is flexible in a plane perpendicular to the plane of rotation (c) to create a desired curvature, angle, or both with which to maneuver around obstacles when using the wrench (d) to apply torque to the flexible wrench from a solid handle capable of multiple angles (e) various types of wrench heads could be attached to increase its usefulness (f) the unit is easy and simple to manufacture and assemble Further objects and advantages will become apparent from a consideration of the drawings and ensuing description.

SUMMARY

The ratchet wrench with an adjustable handle has a segmented section such that it is flexible in a plane perpendicular to the plane of rotation allowing for greater flexibility along the entire length of the wrench. In addition, the handle's angle can be changed to various fixed positions from a zero to a 90-degrees in either direction, allowing for movement on two planes.

DRAWINGS

Figures

For the purposes of facilitating an understanding of the subject matter sought to be protected, there are illustrated in the accompanying drawings embodiments thereof, from an inspection which, when considered in connection with the following description, the subject matter sought to be protected, its construction and operation, and many of its advantages should readily be understood and appreciated.

Figure 1:
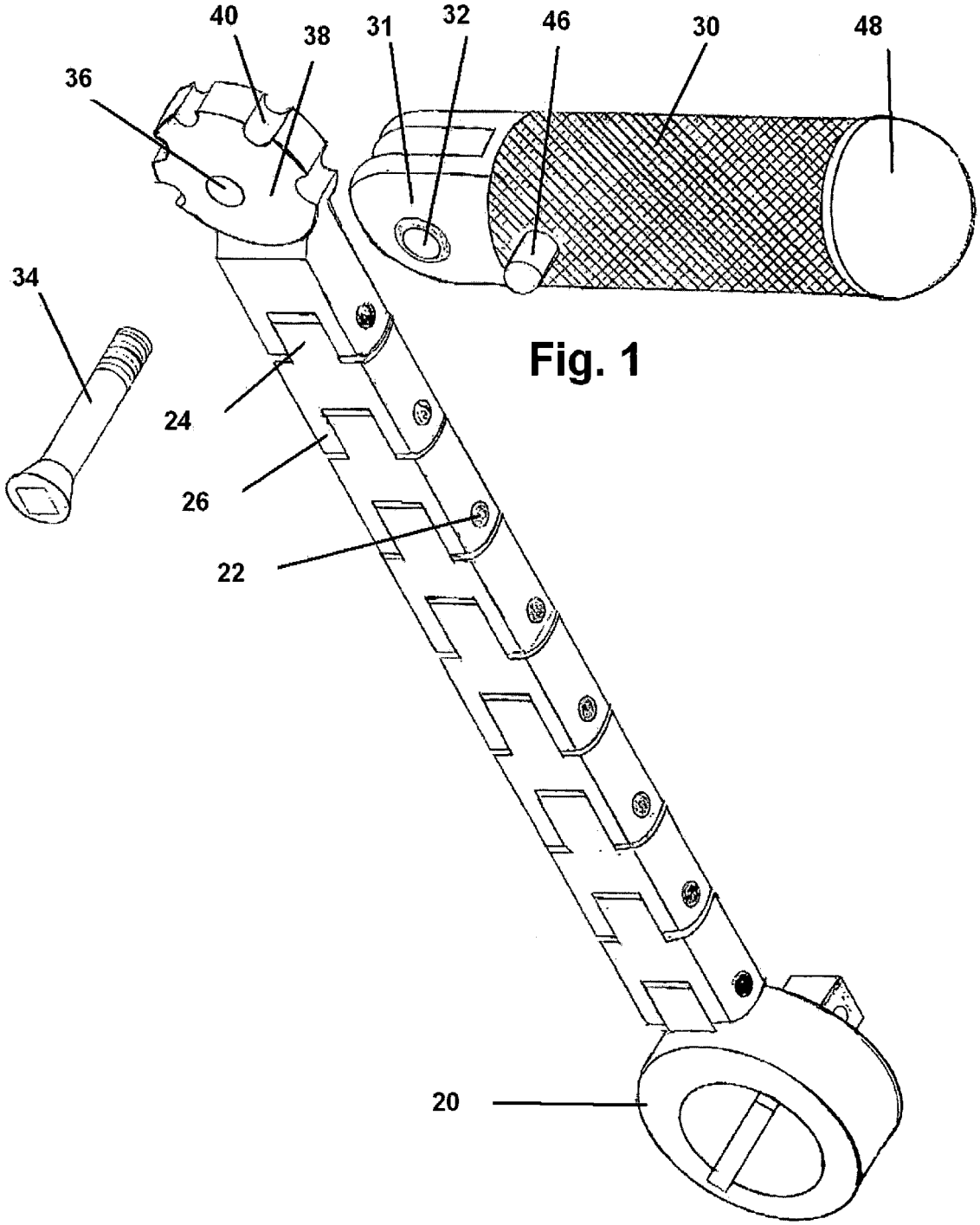
FIG. 1 is an isometric plan view of a first embodiment of the flex handle ratchet.

| DRAWINGS-REFERENCE NUMERALS | |
|---|---|
| 20 | ratcheting wrench head |
| 22 | mushroom head steel pin |
| 24 | stud with rounded end |
| 26 | slotted cavity |
| 28 | pin release cap (second embodiment) |
| 30 | knurled handle |
| 31 | slotted handle cavity |
| 32 | steel screw hole |
| 34 | steel screw |
| 36 | rotating locking stud axis hole |
| 38 | rotating locking stud |
| 40 | locking-pin cavity |
| 42 | locking pin (second embodiment) |
| 44 | locking-pin spring (second embodiment) |
| 46 | ratcheting grip's locking pin |
| 48 | fixed grip cap |
| 50 | locking pin spring |
| 52 | ratcheting grip's release notch |
| 54 | single handle joint (prior art) |
| 56 | fixed handle (prior art) |
| 58 | second ratchet joint (prior art) |

DETAILED DESCRIPTION

FIGS. 1-5

Preferred Embodiment

A preferred embodiment of the segmented ratchet with an adjustable handle is illustrated in FIG. 1. The adjustable handle 30 fits onto the wrench where the rotating locking stud 38 fits into the slotted handle cavity 31. The steel screw 34 connects the two pieces through the axis hole 36 of the rotating locking stud and the steel screw hole 32 of the adjustable handle. Between the adjustable handle and the ratcheting wrench head 20 are the flexible links of the wrench.

The rotating locking stud 38 is tightly connected to the steel links through a slotted cavity 26, by means of a tight fitting removable mushroom head steel pin 22. At the other end of the steel link is a stud with rounded end 24 that is inserted into the slotted cavity 26 of the next steel link. Numerous links are thus tightly connected to form any desirable length of a flexible drive wrench. The links are all tightly fitted together. The last steel link ends in a ratcheting wrench head 20 which is connected to the last stud of the flexible drive wrench by a mushroom head steel pin 22.

Figure 2:
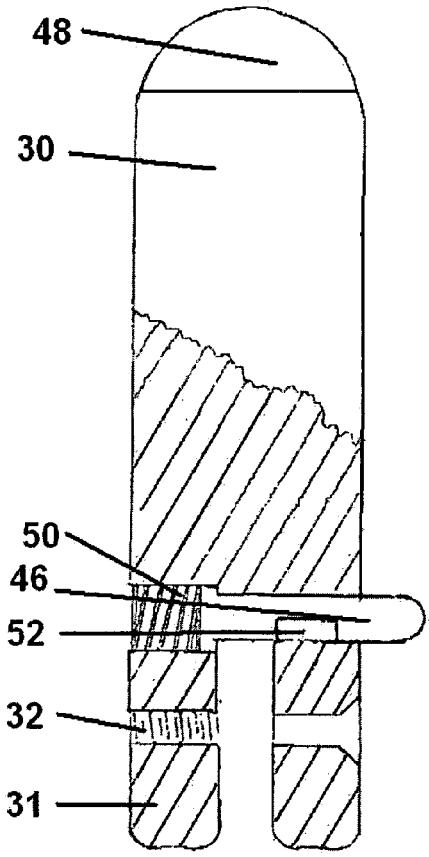
FIG. 2 is an enlarged cross-section of the adjustable handle of the wrench from FIG. 1.
Figure 3:
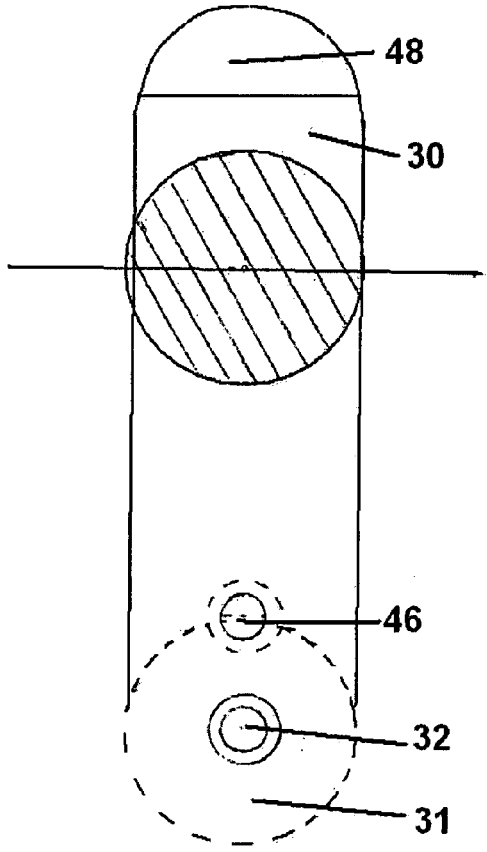
FIG. 3 is an enlarged side view of the adjustable handle from FIG. 2.
Figure 4:
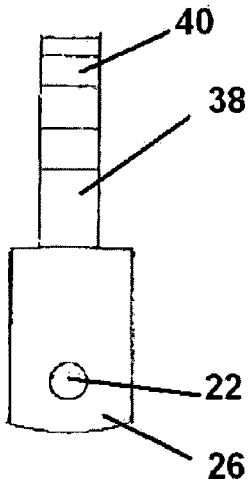
FIG. 4 is an enlarged top view of the rotating locking stud.
Figure 5:
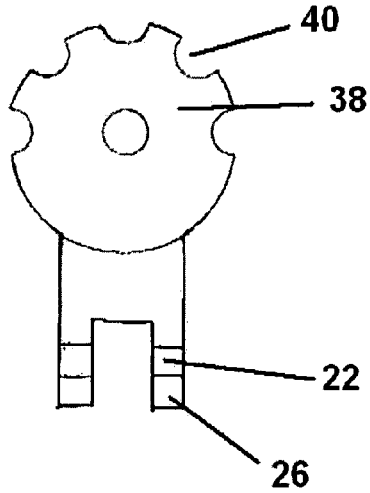
FIG. 5 is a side view of the rotating locking stud from FIG. 4.

FIG. 2 and FIG. 3 show a close-up, cross-sectional view of the adjustable handle. The knurled handle houses the ratcheting system that allows the wrench to be flexible on another plane of movement. FIG. 2 shows the cross-section where the locking pin is located 46. The pin 46 is ordinarily kept in the locked position by the locking pin's spring 50. The spring 50 keeps tension on the locking pin so that the pin is constantly engaged with the locking-pin cavity 40 of FIGS. 4 and 5. In order to adjust the handle, the locking pin 46 must be disengaged from the locking-pin cavity 40 by pressing-in the locking pin. This allows the adjustable grip's release notch 52 to line-up with the rotating locking stud 38. By releasing the locking pin 46, the release notch 52 will disengage and the pin will then engage the next locking-pin cavity 40. This changes the angle of the adjustable handle on a plane different from the movement of the steel links. FIG. 5 indicates the five different angles capable with this rotating locking stud 38; however, the number of angles can change on different embodiments. Unlike the second embodiment, the grip cap 48 is permanently affixed to the handle.

Figure 6:
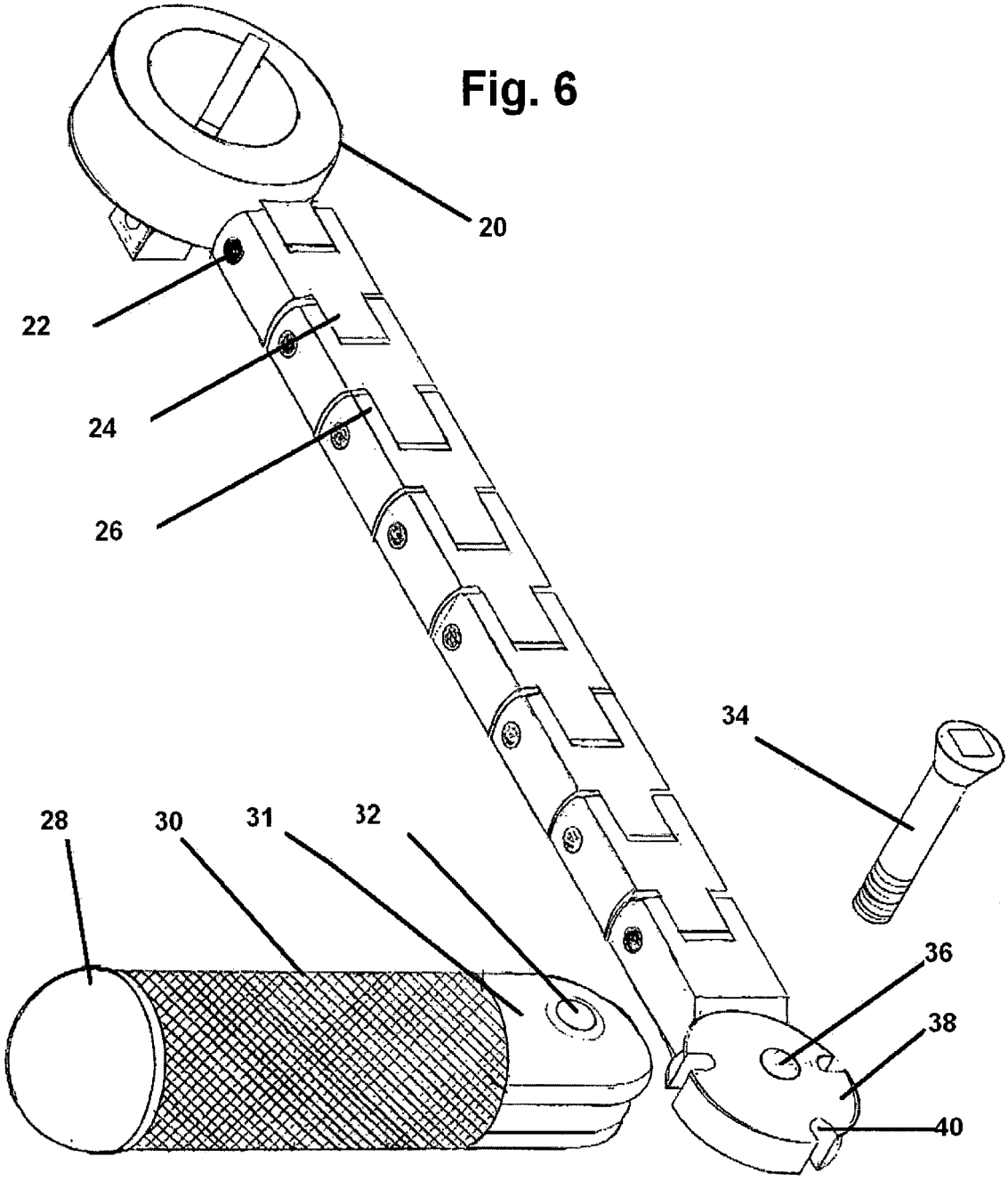
FIG. 6 is an isometric plan view of the second embodiment of the flex handle ratchet.
Figure 7:
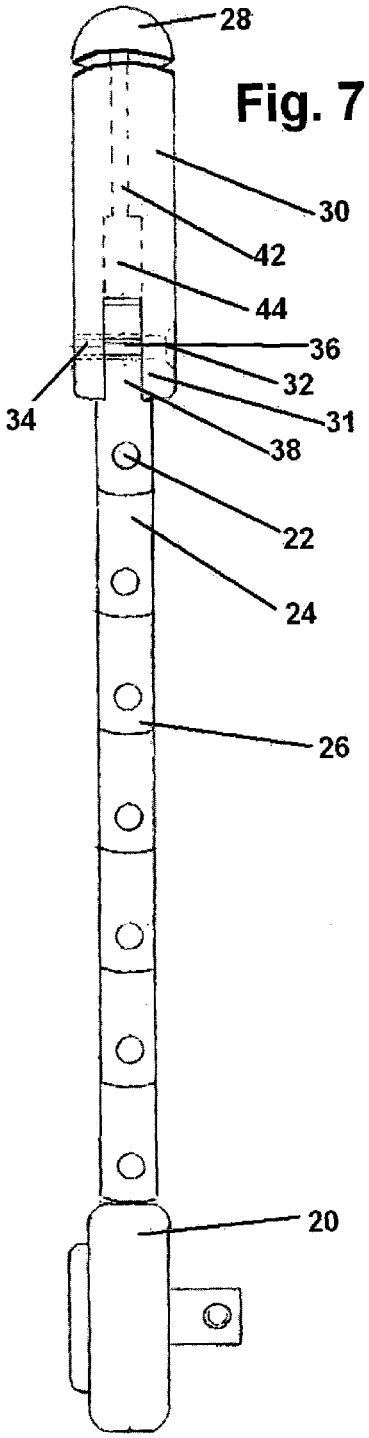
FIG. 7 is a side view of the ratchet in FIG. 6.
Figure 8:
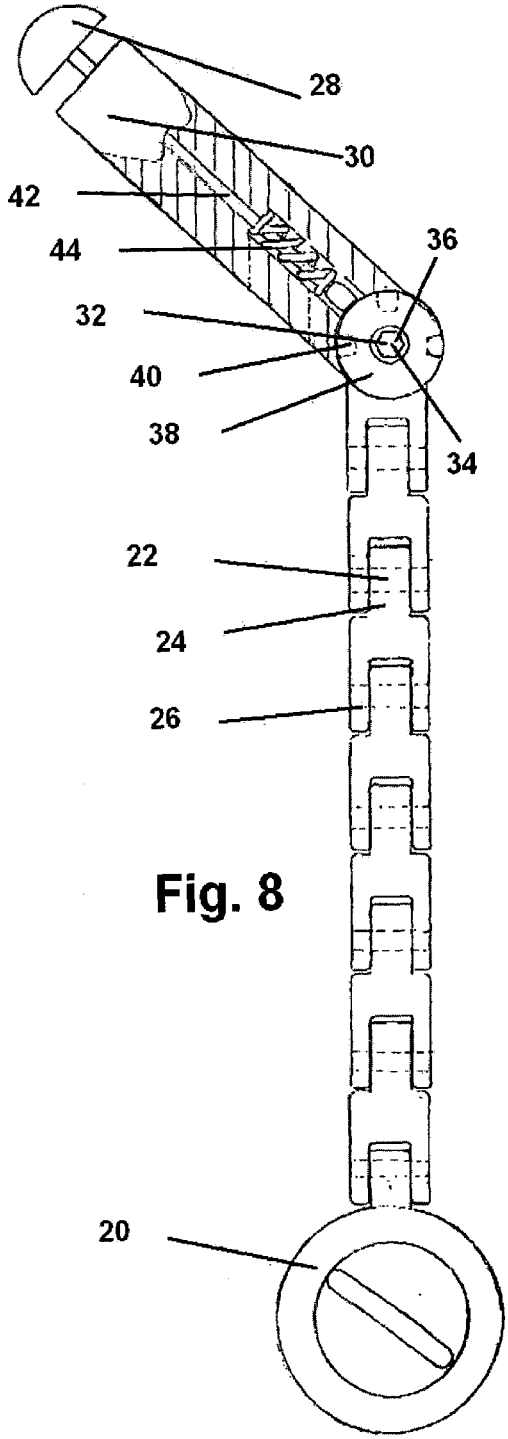
FIG. 8 is a top view of a cross-section of the wrench from FIG. 6.

FIGS. 6, 7, and 8

Second Embodiment

The flexible chain links of the primary embodiment in FIG. 1 are the same as in the additional embodiment. The difference occurs in the adjustable handle 30 of the wrench, which is well displayed in the cross-section image of FIG. 8. The handle is adjusted by pulling on the grip cap 28 located at the end of the handle. By pulling on the pin release cap 28, the locking pin 42 disengages from the locking pin cavity 40 located on the rotating locking stud 38. Once the desired angle is achieved with the handle 30, the pin release cap 38 can be released. The locking-pin spring 44 will then engage the locking pin 42 with the locking-pin cavity 40. The handle is then locked into its new position.

Figure 9:
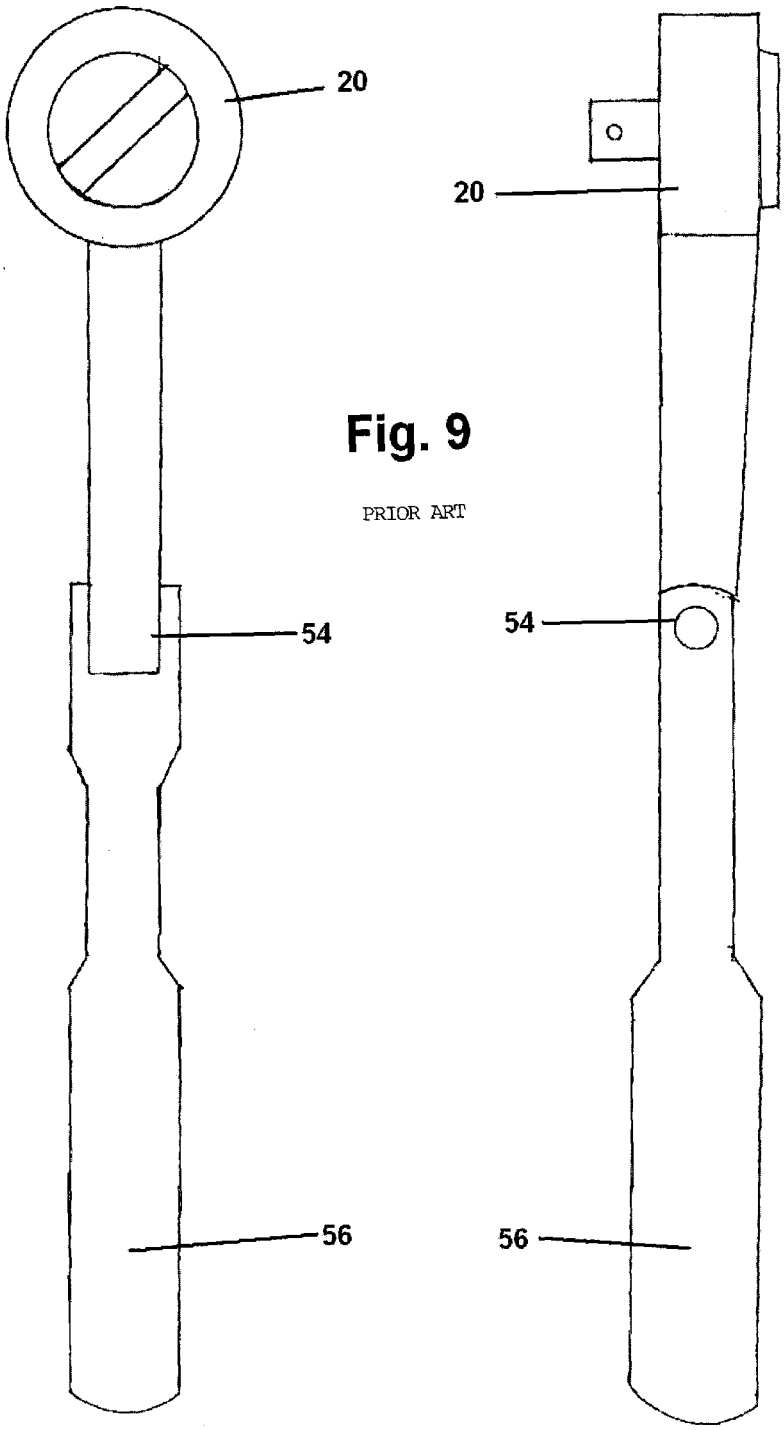
Fig. 9 PRIOR ART
FIG. 9 is prior art with a single adjustable joint.
Figure 10:
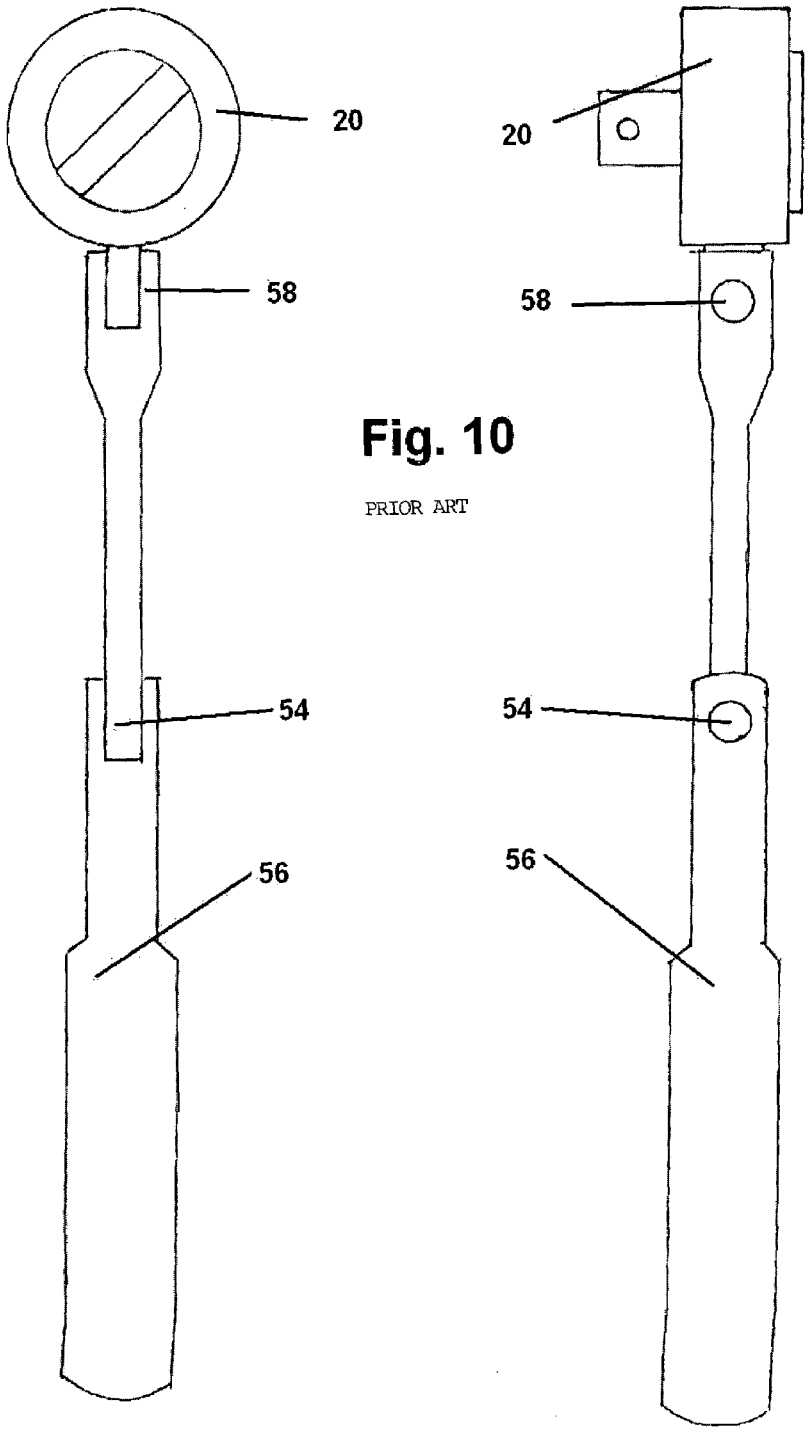
Fig. 10 PRIOR ART
FIG. 10 is prior art with two adjustable joints.

FIGS. 9 and 10

Prior Art

Previous attempts at creating an adjustable ratchet handle have met with only limited success because of their limited mobility. FIG. 9 shows a ratchet with only one adjustable position in the middle of the handle 56, while FIG. 10 shows an additional adjustable position 58 near the ratchet head 20. Neither of these inventions allows for movement on more than one plane, nor do they offer the same degree of flexibility for maneuvering around small spaces.

CONCLUSION, RAMIFICATIONS, AND SCOPE OF THE INVENTION

Thus the reader will see that the adjustable handle of the wrench, in addition to the flexible chain links, allow for flexibility in two plains of movement. The device is simple to make and is easy to use. While my above description contains much specificity, these should not be construed as limitations on the scope of the invention, but rather as an exemplification of one preferred embodiment thereof. Many other variations are possible, including the second embodiment.

For example, the adjustable handle could include more adjustable angles, giving it a greater degree of flexibility; the design could also include less adjustable angles, making the invention easier to use. Also, more chain links could be added, or they could be made larger or smaller, depending upon the needs of the consumer. Further, standard wrenches, screwdriver heads, and other tools could be attached to the adjustable handle. Accordingly, the scope of the invention should be determined not by the embodiments illustrated, but by the appended claims and their legal equivalents.

We claim:

1. A flexible wrench capable of movement on two planes, comprising a segmented section and an angularly adjustable handle, the segmented section including a series of at least three links such that it is flexible in a plane perpendicular to the plane of rotation of the wrench, wherein:

said links are configured such that said segmented section is capable of flexing at least 180 degrees;

said segmented section further including a link having a rotating locking stud comprising a plurality of locking-pin cavities located on an outer radius of said rotating locking stud, and an axis hole located in the center of said rotating locking stud;

said handle comprising a slotted handle cavity located at an end thereof for receiving and pivotally connecting said handle to said rotating locking stud; a through hole located at a center of said slotted handle cavity; a locking pin; and a locking pin spring located inside said adjustable handle immediately above said slotted handle cavity and substantially near one side of said slotted handle cavity; wherein said adjustable handle rotates a minimum of 180 degrees; and, said adjustable handle rotates on one plane of movement and said segmented section flexes on another plane of movement in said wrench body.

2. The flexible wrench according to claim 1 wherein said segmented section further includes a tool head located at an end opposite said rotating locking stud.

* * * * *